United States Patent [19]

Irwin, Jr.

[11] 3,948,594

[45] Apr. 6, 1976

[54] CERAMIC REFRACTORY SETTER

[75] Inventor: William W. Irwin, Jr., East Liverpool, Ohio

[73] Assignee: The Joseph Dixon Crucible Company, Jersey City, N.J.

[22] Filed: Oct. 21, 1974

[21] Appl. No.: 516,189

[52] U.S. Cl. ..... 432/259; 264/58; 432/253

[51] Int. Cl.[2] ..... F27D 5/00

[58] Field of Search ..... 432/253, 258, 259, 5, 6; 264/57–59; 248/346

[56] References Cited

UNITED STATES PATENTS

| | | | |
|---|---|---|---|
| 1,775,535 | 9/1930 | Mayer | 432/259 |
| 2,208,734 | 7/1940 | Schreiber | 432/259 |
| 3,137,910 | 6/1964 | Cummings | 432/259 |
| 3,266,116 | 8/1966 | Rush | 432/259 |

*Primary Examiner*—John J. Camby
*Assistant Examiner*—Henry C. Yuen
*Attorney, Agent, or Firm*—Buell, Blenko, and Ziesenheim

[57] ABSTRACT

The specification discloses a ceramic refractory setter for supporting and protecting an article during glost firing. The setter is of lightweight refractory material in the form of an inverted annular shallow cup-shaped element, adapted to be interlockingly stacked or nested with other setters on the rims thereof. The inwardly extending annular flange at the top of the element is inclined upwardly and has an annular groove of arcuate cross section adjacent the inner circular edge in which a plurality of smooth ceramic balls are disposed in circumferentially spaced relation on which an article to be fired, such as a plate, is adapted to be supported.

4 Claims, 3 Drawing Figures

CERAMIC REFRACTORY SETTER

This invention relates to refractory setters for supporting ceramic articles, such as plates, in stacked relation during a glost firing operation.

Present day practice in the manufacture of glazed or glost dinnerware involves supporting the ware, after being dipped in unfused glaze, on a plural point support provided by disposable refractory elements of different shapes, such as upright pins, tetrahendrons, or spheres.

U.S. Pat. Nos. 1,941,941, 2,881,502, 2,927,362, 3,137,910 and 3,266,116 are illustrative of present day practices in supporting ware during firing operations. As the glaze fuses during the firing operation, it will run and fuse to the support pins or elements, thus requiring the pins in some cases to be broken away or otherwise removed from the ware after it is removed from the kiln. Often fragments of the refractory material are left in the fused glaze and must be ground away or dressed.

It is an object of this invention to provide an improved refractory setter which enables the support and protection of ware during the firing operation in such a manner as to avoid excess scarring or marking of the glaze, thereby eliminating the necessity for dressing and dressing costs.

A further object of the invention is to provide a setter adapted in use to support more than one size of dinnerware with one size setter.

A further object is to provide a setter of such construction as to enable installation of ware therein and stacking of the setters with a maximum ease of effort and minimum expenditure of time.

In order to attain the above described objectives, I provide a lightweight setter of refractory material in annular form having a vertical rim and extending inwardly from the top of the rim, an upwardly inclined flange, which flange has adjacent the inner circular edge thereof a circumferential groove of curved cross section in which are disposed a plurality of uniformly spaced ceramic spheres or balls on which dinnerware of varying diameter is adapted to rest during the firing operation.

I further provide a refractory setter of the type described in the preceding paragraph in which the top of the annular rim of the setter is circumferentially recessed to form a flat shoulder, whereby to provide an interlocking support for a superposed setter, thus enabling the setters to be arranged in a stable manner in nested stacks to permit movement into and out of a kiln, while in stacks, with assurance.

A preferred embodiment of the invention is described in detail hereinafter in connection with the accompanying drawings, wherein.

Figure 1:
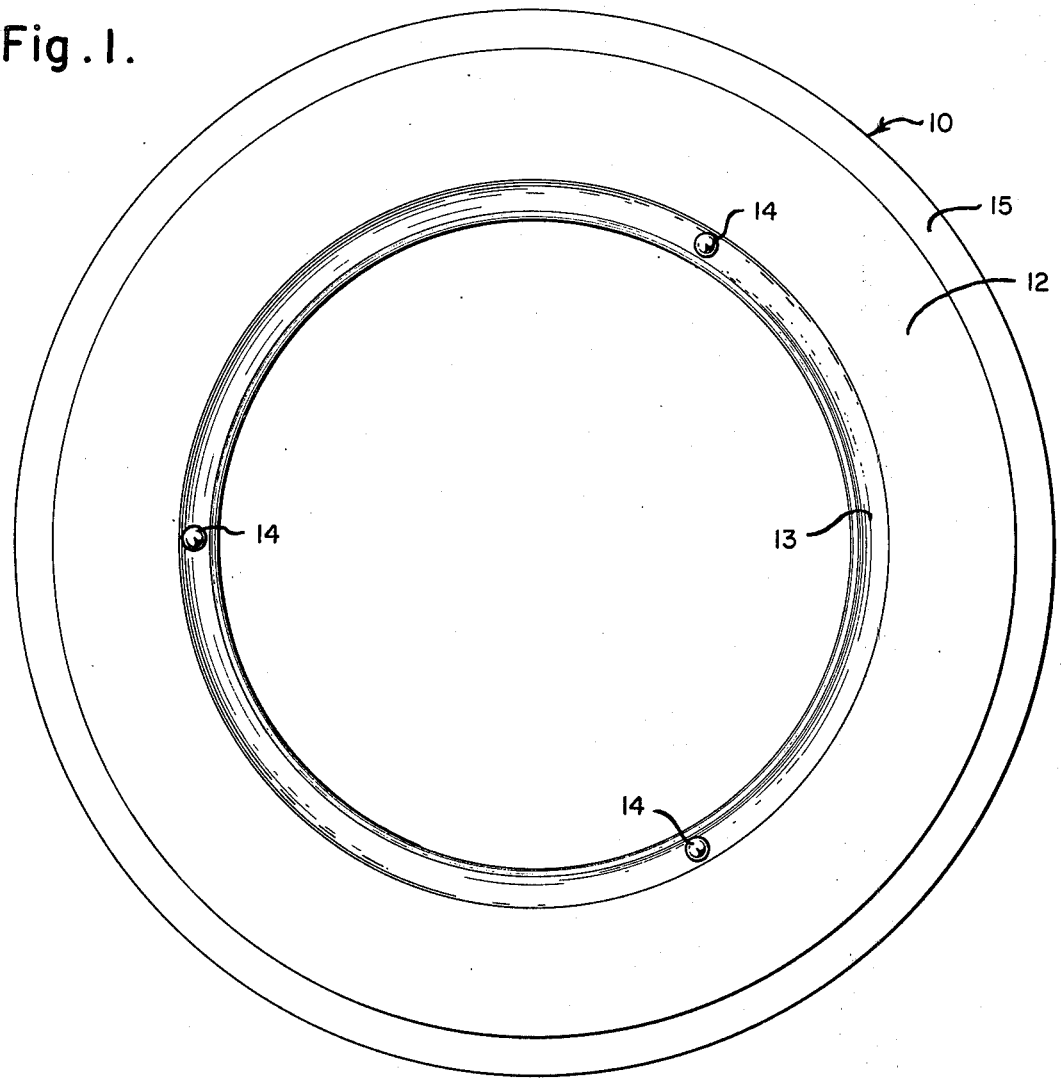
FIG. 1 is a plan view of a refractory setter constructed according to the invention.
Figure 2:
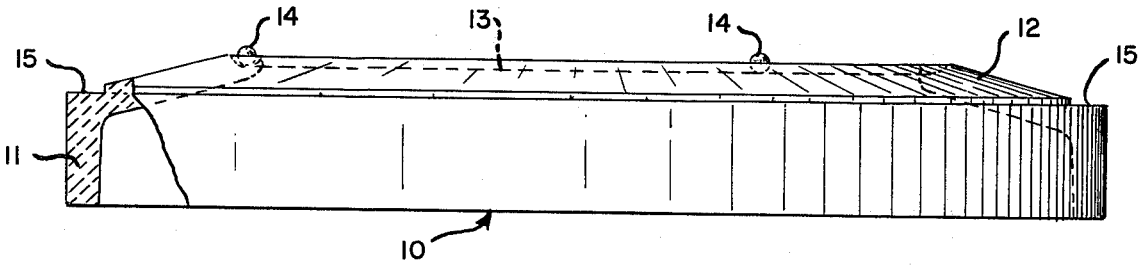
FIG. 2 is a side elevational view of the refractory setter shown in FIG. 1.
Figure 3:
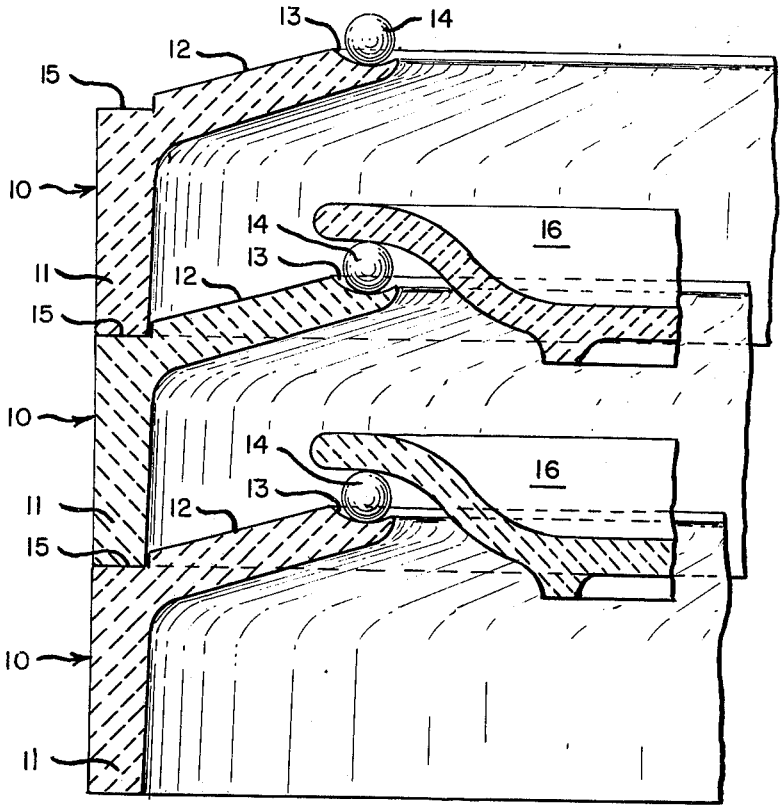
FIG. 3 is a fragmental sectional view, on enlarged scale showing the manner in which the setters support the ware in nested stacks.

Referring to the drawings, the refractory setter 10 shown is a one-piece annulus having a vertically extending circumferential rim 11, from the top of which an annular flange 12 extends inwardly. The flange 12 is inclined slightly upwardly, for example at approximately 15°, and has adjacent its inner edge a circumferential groove 13. Groove 13 is preferably of curved or arcuate cross-section and the bottom of the groove lies in a horizontal plane parallel to the bottom surface of the rim 11. Other cross-sectional contours may be employed for the groove so long as the bottom of the groove is maintained in a horizontal plane. A plurality of smooth ceramic spheres or balls 14, for example three in number, arranged in the groove 13 in substantially uniformly spaced relation are provided for the support of ware thereon, as shown in FIG. 3. The spheres 14 are of smaller radius than the radius of curvature of the groove, being of the order of ¼ to ⅜ inch (6–9mm) in diameter. Thus, they are adapted to move to a limited extent radially or circumferentially, during the firing operation to adjust to expansion and contraction of the ware. As evident in FIGS. 2 and 3, the bottom of the groove is below the inner extremity of flange 12, thus insuring that the spheres remain within the groove.

At the top of the rim 11 is a circumferential recess 15 forming a flat annular shoulder on which the bottom edge of the rim of a superposed setter is adapted to seat interlockingly. Thus, as evident in FIG. 3, a series of setters may be superposed one on the other in a vertical stack. It will be seen that the construction of the setter is such as to provide for ease of stacking without time being wasted in orienting the setters circumferentially as is necessitated in the setter construction shown in prior patents, for example U.S. Pat. No. 1,941,941.

Moreover, in placing the article of ware 16 (FIG. 3) in the setter, it is not necessary to place the ceramic spheres 14 in any particular location in the groove 13, it being important only to arrange the spheres in fairly uniformly spaced relation. Thus, if three spheres are employed, they may be arranged approximately 120° apart before the article of ware is placed thereon. Likewise, if four spheres are employed, they are preferably spaced approximately 90° apart in the groove 13.

It will be seen, therefore, that since the spheres may be placed in any location in the groove, time need not be wasted in trying to fit them into a specific location or slot, as is the case with the pins 21 in U.S. Pat. No. 1,941,941 or with the balls 8 in U.S. Pat. No. 3,266,116.

It will be understood that articles of ware 16 of different diameter and configuration may be supported in the setters 10 by reason of the fact that the spheres 14 are inherently rotationally and radially positionable in the curved groove 13 to conform to the configuration of the ware supported while at the same time maintaining a single point of tangency with the article of ware. Accordingly, the number of different sizes of setters required may be greatly reduced, thereby effecting a consequent capital saving as well conservation of space requirements for storage of the setters. Moreover, I have found that the ceramic spheres are reusable as many as 8 to 10 times, thereby effecting a considerable saving over the conventional refractory elements, such as pins, which are customarily disposed of after each use.

It will be apparent that I have provided a lightweight refractory setter of improved construction enabling reduction of capital expenditures as well as of operating and labor costs. While a specific embodiment has been described herein, it should be understood that modifications, such as vented rims, may be provided within the scope of the following claims.

What I claim and desire to secure by Letters Patent is as follows:

1. A refractory setter for the support of ceramic ware during glost firing, comprising a one-piece annulus having a vertically extending circumferential rim and an annular flange integrally joined to the said rim adjacent the top of the rim, said flange extending inwardly from said rim and being inclined upwardly at a angle of substantially 15°, said flange further having a circumferential groove adjacent the inner edge thereof, and a plurality of ceramic spheres disposed in substantially uniformly spaced relation in said groove on which articles of ceramic ware are adapted to rest.

2. A refractory setter according to claim 1, wherein the bottom surface of the circumferential groove in said flange lies in a horizontal plane below the inner extremity of said flange.

3. A refractory setter according to claim 2, wherein the groove in said flange is circular and of uniform arcuate cross-section throughout.

4. A refractory setter according to claim 3, wherein the ceramic spheres are of a radius less than the radius of curvature of said groove.

* * * * *